US006713673B2

(12) United States Patent
Kao

(10) Patent No.: US 6,713,673 B2
(45) Date of Patent: Mar. 30, 2004

(54) STRUCTURE OF SPEAKER SIGNAL LINE

(75) Inventor: Shih-Chieh Kao, San Diego, CA (US)

(73) Assignee: Capativa Tech, Inc., San Diego, CA (US)

( * ) Notice: Subject to any disclaimer, the term of this patent is extended or adjusted under 35 U.S.C. 154(b) by 0 days.

(21) Appl. No.: 10/180,052

(22) Filed: Jun. 27, 2002

(65) Prior Publication Data

US 2004/0000420 A1 Jan. 1, 2004

(51) Int. Cl.[7] ..... H01B 7/34; H01B 7/00
(52) U.S. Cl. ..... 174/36; 174/113 C
(58) Field of Search ..... 174/36, 110 R, 174/111, 113 R, 113 A, 113 AS, 113 C, 115, 117 F, 117 FF, 102 R, 105 R, 108

(56) References Cited

U.S. PATENT DOCUMENTS 4,443,277 A * 4/1984 Rokas ..... 156/50
4,767,890 A * 8/1988 Magnan ..... 174/28
5,266,744 A * 11/1993 Fitzmaurice ..... 174/103
5,376,758 A * 12/1994 Kimber ..... 174/128.1
5,393,933 A * 2/1995 Goertz ..... 174/117 R
5,519,173 A * 5/1996 Newmoyer et al. ..... 174/113 R
5,552,565 A * 9/1996 Cartier et al. ..... 174/117 F
5,745,628 A * 4/1998 Benzel et al. ..... 385/104
5,834,699 A * 11/1998 Buck et al. ..... 174/113 R
5,883,334 A * 3/1999 Newmoyer et al. ..... 174/113 R
6,359,230 B1 * 3/2002 Hildreth ..... 174/110 R

FOREIGN PATENT DOCUMENTS

DE 29721701 U1 * 5/1998 ..... G02B/6/44
EP 0962945 A1 * 12/1999 ..... H01B/7/08

* cited by examiner

*Primary Examiner*—William H. Mayo, III
(74) *Attorney, Agent, or Firm*—Troxell Law Office PLLC

(57) ABSTRACT

A structure of a speaker signal line having a middle filler layer, a plurality of transmission conductors and an outer coating portion, wherein, the middle filler layer is comprised of many hollow tubes. The transmission conductors are equidistantly spaced and wrapped over the middle filler layer. The coating portion is made of polyvinyl chloride composition. The middle filler lay is formed in the way of entangling to increase its strength and flexibility. The transmission conductors are spaced mutually in different layers and wrapped over the middle filler layer in mutual contrary directions. All the elements above are combined together by adding the outer coating portion, thereby, the inductive resistance induced by the transmission conductors equidistantly spaced in different layers and wrapped in mutual contrary directions can be mutually offset.

9 Claims, 5 Drawing Sheets

STRUCTURE OF SPEAKER SIGNAL LINE

BACKGROUND OF THE INVENTION

1. Field of the Invention

The present invention is related to a structure of a speaker signal line, and especially to a structure of signal line with conductors of rectangular cross sections wrapped in mutual contrary directions and equidistantly arranged in different layers; it is suitable particularly for use in signal transmission lines such as those for speakers or the like.

2. Description of the Prior Art

The materials of wires have certain influence on the effect of a hi-fi set, the materials of wires of a good hi-fi set are necessary to have small resistance, capacitance, inductance as well as skin effect; and have fast transmission speed; to have the quality of the wires for transmission elevated is the natural tendency. A conventional transmission line for a speaker, such as that shown in FIG. 1, is comprised of a plurality of conductors gathering in bundles "B", and they are enveloped in a PVC insulation layer "C", these are further enveloped in a coating layer "A" to form a speaker signal line. When a user uses such a conventional speaker signal line, by the fact that the plural conductors are spaced very close to one another, and they only are insulated by the PVC coating layer "A", it gets interference not only by the plural conductors themselves acting mutually, but also by other external conductors, hence the transmission of sound is influenced. And more, the inner core components are round, their transmission effect is inferior to those rectangular core components like wave-guiding tubes, and cannot meet the quality requirement of high fidelity transmission.

Referring to FIG. 2 showing another conventional structure of a speaker signal line like a wave-guiding tube, the signal line is made a tube body 1 from a PVC insulation layer, the inner wall of the tube body 1 is provided with two hollow thin pipes 2 with a space 4 therebetween, the two hollow thin pipes 2 are both extended therein a rectangular conductor 3 for effectively improving on the transmission effect of the abovementioned round core components. However, by virtue that there are only two hollow thin pipes 2 in the tube body 1, and the rest space 4 is empty, the strength of the tube body 1 is not enough, the space 4 (distance) between the two conductors 3 may change by bending, thereby the two conductors 3 not only mutually interfere with each other, but also signal transmission may be influenced by deformation of the two conductors 3 induced by pressing on the weak hollow tube body 1. Besides, the conductors are only a couple by amount; the conventional structure of signal line is not ideal either.

Therefore, the motive in study and development of the present invention is to improve on the defects resided in the conventional structures of speaker signal lines, in order to provide a structure of a speaker signal line which can offset the inductive resistance induced by transmission media and can increase the transmission speed and quality suitable for use by consumers.

SUMMARY OF THE INVENTION

The primary object of the present invention is to provide a structure of a speaker signal line of which the transmission conductors will not be mutually interfered, and the transmission speed and quality thereof can be increased.

To achieve the stated object, the present invention is comprised of a middle filler layer, a plurality of transmission conductors and an outer coating portion. The middle filler layer is comprised of a plurality of hollow tubes; the plural transmission conductors are spaced mutually and wrapped over the middle filler layer; the outer coating portion is made of polyvinyl chloride composition. Wherein, the filler components of the middle filler layer are tangled with one another to increase its strength. The transmission conductors are equidistantly spaced in different layers and wrapped over the middle filler layer in mutual contrary directions, and then the above members are altogether connected integrally in the outer coating portion. A wrapping roll made from a foamed Teflon tape is added between every two layers for separation, thus a structure of a speaker signal line is completed. The structure can have the inductive resistance induced by transmission media offset and can have the transmission speed and quality increased by providing the transmission conductors equidistantly spaced in different layers and wrapped in mutual contrary directions.

The present invention will be apparent after reading the detailed description of the preferred embodiment thereof in reference to the accompanying drawings.

DETAILED DESCRIPTION OF THE PREFERRED EMBODIMENT

Figure 1:
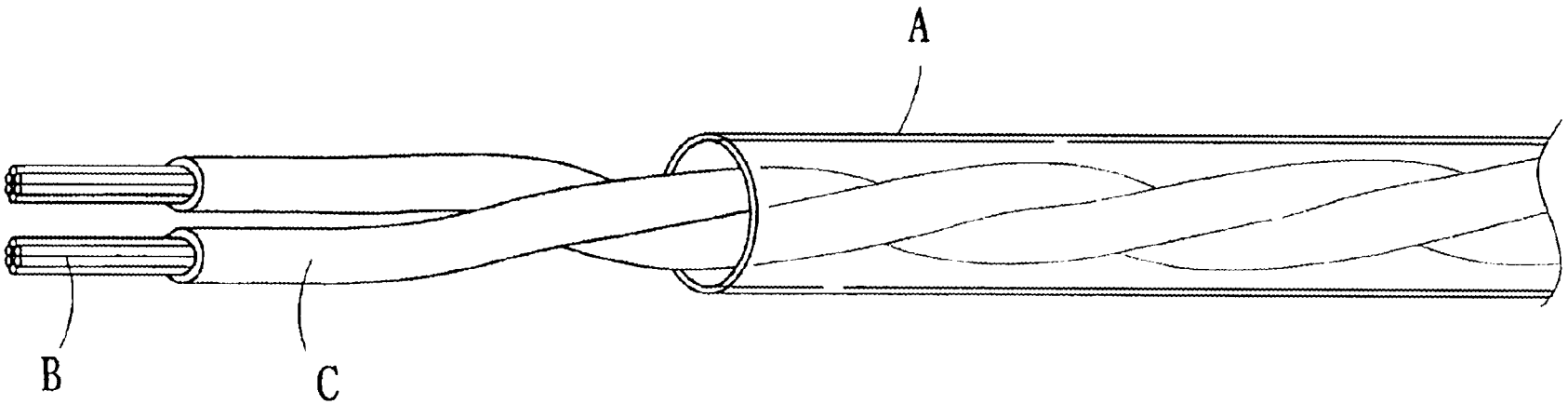
Fig. 1 (Prior Art)
FIG. 1 is an analytic perspective view showing the structure of a conventional speaker signal line.
Figure 2:
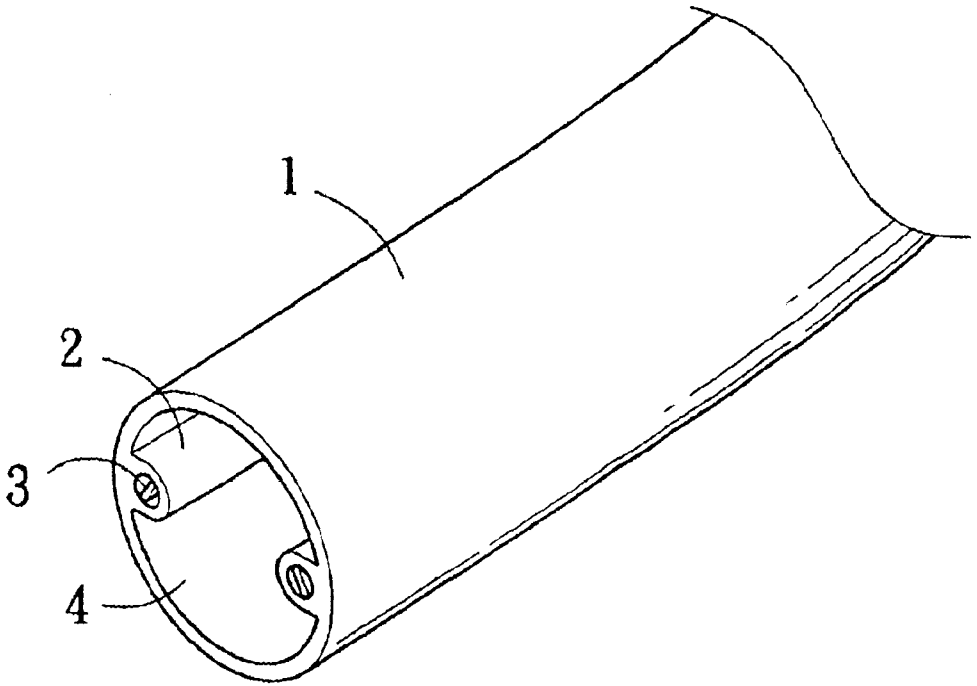
Fig. 2 (Prior Art)
FIG. 2 is a perspective view showing the appearance of another conventional speaker signal line.
Figure 3:
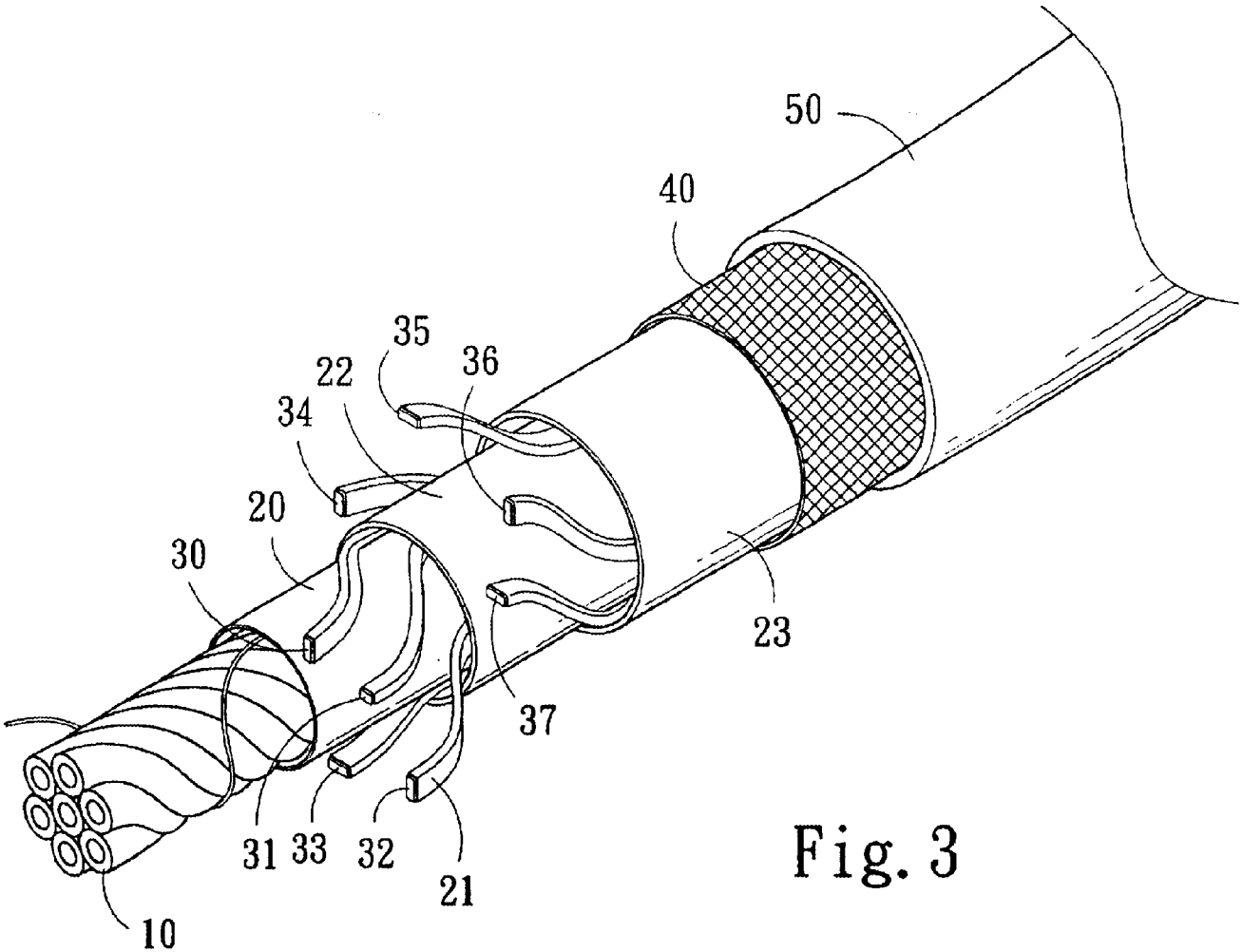
FIG. 3 is an analytical perspective view showing the structure of an embodiment of the present invention.
Figure 4:
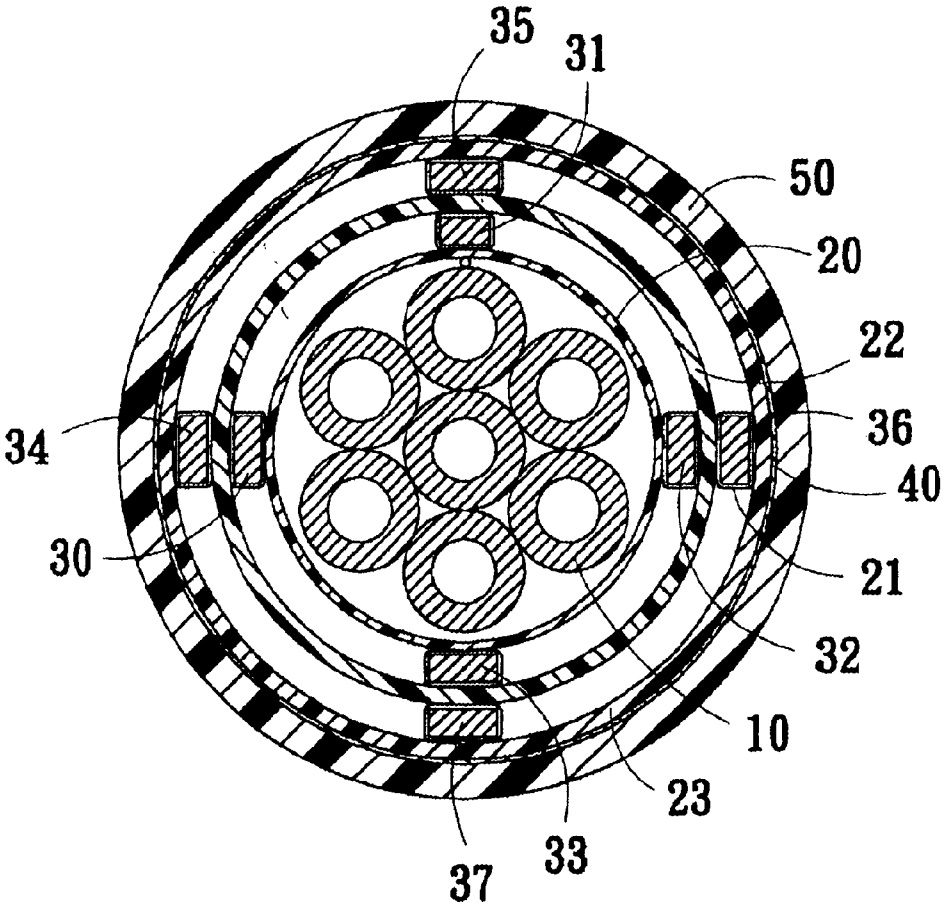
FIG. 4 is a cross-sectional view of the embodiment of the present invention.

Referring firstly to FIGS. 2 and 3, the present invention is comprised of a middle filler layer 10, a plurality of transmission conductors 30–37 and an outer coating portion 50. Wherein, the middle filler layer 10 is comprised of a plurality of hollow tubes entangled in an identical direction to form a large bundle, and is tightened by binding of a wrapping roll made from a foamed TEFLON polytetrafluoroethylene. (PTFE) tape 20; the plural transmission conductors 30–37 are made of fine metal of single crystal in single direction, in rectangular shapes, and are wrapped up in foamed TEFLON (PTFE) tape 21 to get insulation. Wherein, the four transmission conductors 30–33 are equidistantly spaced and wrapped over the wrapping roll made from the foamed TEFLON (PTFE) tape 20, they are clockwise (or counterclockwise) wrapped over the wrapping roll made from the foamed TEFLON (PTFE) tape 20; after wrapping, the four transmission conductors 30–33 are wrapped up in a wrapping roll made from a foamed TEFLON (PTFE) tape 22; and the other four transmission conductors 34–37 are similarly equidistantly spaced and wrapped over the wrapping roll made from the foamed TEFLON (PTFE) tape 22 and are wrapped thereover in a contrary direction (if the former conductors are wrapped clockwise, these four transmission conductors 34–37 are wrapped counterclockwise, and vise versa). And after wrapping of these, the four transmission conductors 34–37 are wrapped up in a wrapping roll made from a foamed TEFLON (PTFE) tape 23; a knitted fabric insulation layer 40 further envelops the wrapping roll made from a foamed TEFLON (PTFE) tape 23;

finally, the outer coating portion 50 made of polyvinyl chloride (PVC) composition envelops all the above stated members to complete the structure of the present invention. Alternately, the transmission conductors 30–37 can be wrapped with a polyethylene (PE) or a polypropylene (PP) insulating layer. The transmission conductors maybe coated with an anti-oxidation lacquer.

The plural hollow tubes of the middle filler layer 10 are combined with one another by twisting tangling to increase its own strength. With identical cross-sectional areas, the surface area of the rectangular transmission conductors 30–37 is larger than that of the conventional round transmission conductors; thereby, the transmission area and speed of the rectangular transmission conductors are increased. The dielectric coefficients of the Teflon in the wrapping roll 20, 23 made from foamed Teflon (PTFE) tapes and the foamed Teflon (PTFE) tape 21 are all the smallest, hence an excellent insulation effect can be obtained. And the degree of mutual interference can be reduced to the minimum by the fact that, the rectangular transmission conductors 30–37 are wrapped up in a foamed Teflon (PTFE) tape 21 and are covered with the wrapping rolls 20, 22 and 23 made from foamed Teflon (PTFE) tapes to get a multi-layer insulation; mutual interference among the rectangular transmission conductors 30–37 can be minimized, plus entangling of the rectangular transmission conductors 30–37 in mutual contrary directions and being equidistantly arranged in different layers, the inductive resistance induced by the rectangular transmission conductors 30–37 can be mutually offset; this can lower mutual interference and distortion, and can have the transmission speed and quality of the structure of a speaker signal line of the present invention increased. Moreover, the cross section of the positive pole in the signal line is smaller than that of the negative pole; therefore, when a loop is formed, signals transmitted under a fast speed from the positive pole transmission conductors with a smaller cross-sectional area to the negative pole transmission conductors can be more fluent and will not be jammed to influence the quality of transmission.

Figure 5:
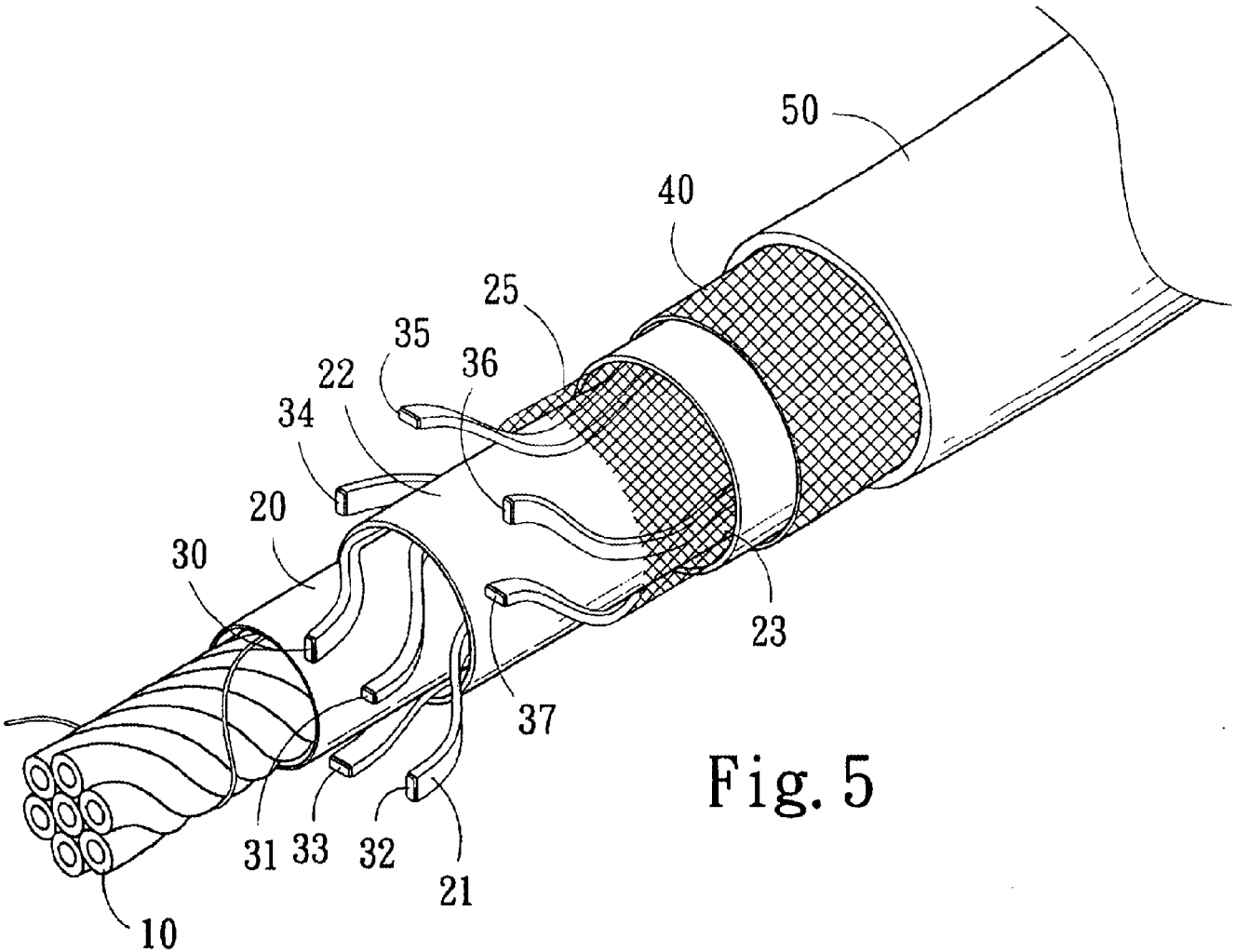
FIG. 5 is an analytic perspective view showing the structure of another embodiment of the present invention.

And referring to FIG. 5, the wrapping roll 20 made from fine TEFLON (PTFE) tape tightly binds up the middle filler layer 10, after the four transmission conductors 30–33 equidistantly spaced are wrapped up and are wrapped thereover clockwise (or counterclockwise), the wrapping roll 22 made from a foamed TEFLON (PTFE) tape is used to wrap over the transmission conductors 30–33; then the four transmission conductors 34–37 are similarly equidistantly spaced and wrapped up over the wrapping roll 22 made from a foamed TEFLON (PTFE) tape in a contrary direction to that of the transmission conductors 30–33 (if the transmission conductors 30–33 are wrapped clockwise, the four transmission conductors 34–37 are wrapped counterclockwise, and vise versa). After wrapping, all the members above are enveloped by an obscuring layer 25 which is a knitted metallic obscuring layer, and then are enveloped by the wrapping roll 23 made from a foamed TEFLON (PTFE) tape and the knitted fabric insulation layer 40; and finally, the outer coating portion 50 made of polyvinyl chloride (PVC) composition envelops all the above stated members to complete the combination structure of the present invention.

Accordingly, the structure of the present invention has the following practical advantages:

1. In comparison of the rectangular core components with the conventional round core components having the same cross-sectional areas, the surface area of the rectangular core components is larger than that of the conventional round core components, thereby, the transmission area of the rectangular core components is increased, this can lower the attenuation of and increase the speed of signal transmission.
2. The transmission conductors are equidistantly spaced in different layers and wrapped in mutual contrary directions, the inductive resistance induced by the transmission conductors can be mutually offset, and the degree of mutual interference can be reduced to not affect the quality of transmission;
3. The hollow tubes of the middle filler layer are twisting tangled in an identical direction; this reinforces the signal line, so that the signal line will not deform during bending.
4. The dielectric coefficients of the Teflon in the wrapping rolls made from foamed Teflon (PTFE) tapes are all the smallest, hence an excellent insulation effect can be obtained; by virtue that the transmission conductors themselves envelop a wrapping roll made from fine metal Teflon (PTFE) tape, and are enveloped by another wrapping roll made from fine metal Teflon (PTFE) tape, the degree of mutual interference can be reduced to the minimum;

The structure of speaker signal line of the present invention can increase the strength of its own by twisting tangling of the middle filler layer to thereby increase the flexibility itself during bending. Such a signal line is surely brand-new as compared to the lines available presently; functional improvement thereof is evident.

Having thus described the invention with industrial value, what I claim as new and desire to be secured by Letters Patent of the United States are:

1. A structure for a speaker signal line comprising:

a) a filler layer having a plurality of twisted hollow tubes;

b) a plurality of transmission conductors made of metal and having rectangular cross-sectional configurations, the plurality of transmission conductors forming two transmission conductor layers encasing the filler layer, the plurality of transmission conductors in each of the two transmission conductor layers being equidistantly spaced apart, the two transmission conductor layers being twisted around the filler layer in opposing directions; and c) an outer coating portion encasing the two transmission conductor layers.

2. The structure for a speaker signal line according to claim 1, wherein the plurality of transmission conductors are encased in an insulating material selected from the group consisting of a foamed polytetrafluoroethylene tape, a polyethylene insulating layer, and a polypropylene insulating layer.

3. The structure for a speaker signal line according to claim 1, wherein the outer coating portion is made of polyvinyl chloride.

4. The structure for a speaker signal line according to claim 1, further comprising three wrapping rolls made of foamed polytetrafluoroethylene tape, the middle filler layer and each of the two transmission conductor layers are encased by one of the three wrapping rolls.

5. The structure for a speaker signal line according to claim 1, further comprising a knitted fabric insulation layer formed on an inner periphery of the outer coating portion.

6. The structure for a speaker signal line according to claim 1, wherein the transmission conductors are made of copper of a single crystal in a single direction.

7. The structure for a speaker signal line according to claim 6, wherein the transmission conductors are coated with an anti-oxidation lacquer.

8. The structure for a speaker signal line according to claim 1, wherein the transmission conductors are coated with an anti-oxidation lacquer.

9. The structure for a speaker signal line according to claim 1, further comprising an obscuring layer positioned between the two transmission conductor layers and the outer coating portion.

* * * * *